US006257339B1

(12) United States Patent
Haugen et al.

(10) Patent No.: US 6,257,339 B1
(45) Date of Patent: Jul. 10, 2001

(54) PACKER SYSTEM

(75) Inventors: David Michael Haugen, League City; Gary Duron Ingram, Richmond; Corey Eugene Hoffman, Spring, all of TX (US); Robert Stephen Beeman, Bossier City, LA (US)

(73) Assignee: Weatherford/Lamb, Inc, Houston, TX (US)

( * ) Notice: Subject to any disclaimer, the term of this patent is extended or adjusted under 35 U.S.C. 154(b) by 0 days.

(21) Appl. No.: 09/411,718

(22) Filed: Oct. 2, 1999

(51) Int. Cl.[7] ..... E21B 33/128
(52) U.S. Cl. ..... 166/387; 166/123
(58) Field of Search ..... 166/376, 387, 166/55.1, 120, 123, 179, 381, 382

(56) References Cited

U.S. PATENT DOCUMENTS

| | | | |
|---|---|---|---|
| 2,893,491 | 7/1959 | Crowe . | |
| 3,282,343 | 11/1966 | Tausch . | |
| 3,344,861 | 10/1967 | Claycomb . | |
| 3,516,703 | 6/1970 | Templeton . | |
| 3,548,936 | 12/1970 | Kilgore . | |
| 3,575,238 | 4/1971 | Shillander . | |
| 3,603,392 | 9/1971 | McGill . | |
| 3,667,543 | 6/1972 | Dean . | |
| 3,706,342 | 12/1972 | Woolley . | |
| 3,710,862 | 1/1973 | Young et al. | 166/278 |
| 3,818,987 | 6/1974 | Ellis . | |
| 3,841,400 * | 10/1974 | Callihan et al. | 166/120 |

(List continued on next page.)

FOREIGN PATENT DOCUMENTS 2 308 138 12/1995 (GB) ..... E21B/33/134

OTHER PUBLICATIONS

Model B Invertible Packer, Petro–Tech Tools, Inc., Jun. 1998.
Set Down Unloader, Petro–Tech Tools, Inc., Aug. 1997.
Thru–Tubing Inflatable Workover Systems, SPE 22825, 1981.
Baker Oil Tools Product Guide, baker Oil Tools Composite Catalog, vol. 1, 1990–91, pp. 21–27.
U.S. Official Gazette—Patents, Entry for U.S. Patent 6,009, 951, Jan. 4, 2000.
PCT/GB00/03726; Invitation to Pay Additional Fees w/ Annex to Form PCT/ISA/206.

* cited by examiner

*Primary Examiner*—Frank Tsay
(74) *Attorney, Agent, or Firm*—Guy McClung

(57) ABSTRACT

A wellbore system with a tubular string extending from an earth surface down into a wellbore in the earth, a packer system with a selectively settable packer element, and a disconnect located between an end of the tubular string and the packer system, the disconnect operable from the surface by imposing a downward force on the tubular string. In one aspect the packer system's packer element is a tension-set packer element. A wellbore disconnect with a top sub, a piston having an upper end secured to the top sub and a portion below the upper end releasably secured with at least one releasable member to a carrier member, the carrier member having apparatus for selectively gripping the piston, the apparatus for selectively gripping the piston also selectively gripping a bottom sub within which the piston is movable, the at least one releasable member releasable in response to a downward force on the disconnect.

30 Claims, 8 Drawing Sheets

U.S. PATENT DOCUMENTS

| | | | | |
|---|---|---|---|---|
| 3,889,750 | | 6/1975 | Mullins . | |
| 3,933,202 | | 1/1976 | Ahlstone . | |
| 4,043,390 | | 8/1977 | Glotin . | |
| 4,151,876 | | 5/1979 | Briggs et al. . | |
| 4,156,460 | * | 5/1979 | Crowe | 166/120 |
| 4,176,715 | * | 12/1979 | Bigelow et al. | 166/138 |
| 4,270,608 | | 6/1981 | Hendrickson et al. . | |
| 4,273,464 | | 6/1981 | Scott . | |
| 4,299,397 | | 11/1981 | Baker et al. . | |
| 4,316,504 | | 2/1982 | Baker et al. . | |
| 4,321,965 | | 3/1982 | Restarick et al. . | |
| 4,433,847 | | 2/1984 | Weinberg . | |
| 4,449,736 | | 5/1984 | Blackwell | 285/3 |
| 4,545,431 | | 10/1985 | Fore . | |
| 4,576,230 | * | 3/1986 | Tapp et al. | 166/382 |
| 4,593,765 | | 6/1986 | Greenlee . | |
| 4,625,799 | | 12/1986 | McCormick et al. . | |
| 4,648,445 | | 3/1987 | Caskey . | |
| 4,648,446 | | 3/1987 | Fore et al. . | |
| 4,655,289 | | 4/1987 | Schoeffler . | |
| 4,662,452 | | 5/1987 | Ross et al. | 166/334 |
| 4,665,978 | | 5/1987 | Luke . | |
| 4,688,634 | | 8/1987 | Lustig et al. . | |
| 4,693,309 | | 9/1987 | Caskey . | |
| 4,708,208 | | 11/1987 | Halbardier . | |
| 4,750,560 | | 6/1988 | Gazda . | |
| 4,750,564 | | 6/1988 | Pettigrew et al. . | |
| 4,796,707 | | 1/1989 | Halbardier . | |
| 4,805,699 | | 2/1989 | Halbardier . | |
| 4,832,129 | | 5/1989 | Sproul et al. . | |
| 4,869,325 | | 9/1989 | Halbardier . | |
| 4,928,762 | * | 5/1990 | Mamke | 166/192 |
| 4,936,387 | | 6/1990 | Robbo . | |
| 4,949,792 | | 8/1990 | Rubbo et al. . | |
| 4,949,793 | | 8/1990 | Robbo et al. . | |
| 4,951,747 | | 8/1990 | Coronado . | |
| 4,960,181 | | 10/1990 | Marvin et al. . | |
| 4,979,570 | | 12/1990 | Mody . | |
| 4,986,362 | | 1/1991 | Pleasants . | |
| 5,048,613 | | 9/1991 | Shilling . | |
| 5,095,979 | | 3/1992 | Perricone . | |
| 5,143,015 | | 9/1992 | Lubitz et al. . | |
| 5,251,695 | | 10/1993 | Coronado | 166/242 |
| 5,310,001 | | 5/1994 | Burns, Sr. et al. . | |
| 5,311,939 | | 5/1994 | Pringle et al. | 166/134 |
| 5,404,946 | | 4/1995 | Hess . | |
| 5,479,991 | | 1/1996 | Robison et al. . | |
| 5,597,016 | | 1/1997 | Manke et al. . | |
| 5,667,023 | * | 9/1997 | Harrell et al. | 175/45 |
| 5,718,292 | | 2/1998 | Heathman et al. . | |
| 5,720,343 | | 2/1998 | Kilgore et al. . | |
| 5,743,331 | | 4/1998 | Adkins et al. . | |
| 5,775,429 | | 7/1998 | Arizmendi et al. . | |
| 5,881,816 | | 3/1999 | Wright . | |

PACKER SYSTEM

BACKGROUND OF THE INVENTION

1. Field of the Invention

This invention is related, among other things, to wellbore packer systems and, in certain aspects, a tension-set packer run on coil tubing. In other aspects, a set-down disconnect is used with such a system.

2. Description of Related Art

Coil tubing cannot be rotated. Certain prior art down-hole tools that require rotation cannot be used with coil tubing. Consequently, hydraulically set packers are used with coil tubing. Coil tubing can be reciprocated. One prior art patent, U.S. Pat. No. 5,095,979 provides apparatus that operates in well production tubing by reciprocating the coil tubing. The apparatus has a pin moving in a groove that allows a packer to be run into production tubing, set, and released by the longitudinal movement of no coil tubing only.

In certain prior art wellbore operations in which fluid with solids is being pumped into the wellbore (e.g. sand, proppant, or other solids), a ball actuated disconnect may be ineffective. In such situations a disconnect is needed which does not rely on the dropping of a ball.

There has long been a need for an effective and efficient wellbore packer system which can be run on coil tubing. There has long been a need for such a system with a tension-set packer. There has long been a need for an effective and efficient set-down disconnect.

SUMMARY OP THE PRESENT INVENTION

The present invention discloses, in certain embodiments, a wellbore system with a tubular string extending from an earth surface down into a wellbore in the earth, a packer system with a selectively settable packer element, and a disconnect located between an end of the tubular string and the packer system, the disconnect operable from the surface by imposing a downward force on the tubular string. In one aspect the packer system's packer element is a tension-set packer element. In one aspect the system includes selectively settable gripping apparatus for gripping an interior of a bore in which the wellbore system is located.

In certain aspects the wellbore system has selectively cycling apparatus for selective setting of the selectively settable gripping apparatus at a desired location in the wellbore. In one aspect the selective cycling apparatus permits setting of the wellbore system, subsequent un-setting of the wellbore system, relocation of the wellbore system within the wellbore, and re-setting of the wellbore system within the wellbore without retrieval of the wellbore system to the earth surface. In certain aspects, the wellbore system requires at least two up-down reciprocations of the tubular string to set the selectively settable gripping apparatus. The system may have an unloader and a check valve apparatus.

The present invention discloses a disconnect with a top sub, a piston having an upper end secured to the top sub and a portion below the upper end releasably secured with at least one releasable member to a carrier member, the carrier member having apparatus for selectively gripping the piston (e.g. one or more lugs, one or more collet fingers, or a collet gripping end), the apparatus for selectively gripping the piston also selectively gripping a bottom sub within which the piston is movable, the at least one releasable member releasable in response to a downward force on the disconnect.

The present invention discloses a wellbore centralizer with two carriers each with a generally cylindrical hollow body having a bore therethrough from a top to a bottom thereof, a plurality of spaced apart recesses in an exterior of each generally cylindrical hollow body, a plurality of spaced apart bow springs each with two ends, each end within and corresponding in shape to a shape of the plurality of spaced-apart recesses, and an outer sleeve secured to each generally cylindrical hollow body and releasably holding the spring ends within the plurality of spaced-apart recesses.

It is, therefore, an object of at least certain preferred embodiments of the present invention to provide:

New, useful, unique, efficient, nonobvious wellbore packer systems;

Such systems with a tension-set packer run on coil tubing;

Such systems with a set-down disconnect;

Such systems useful in a variety of wellbore operations, including, but not limited to, formation fracturing operations; and New, useful, unique, efficient, nonobvious set-down disconnects.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1:
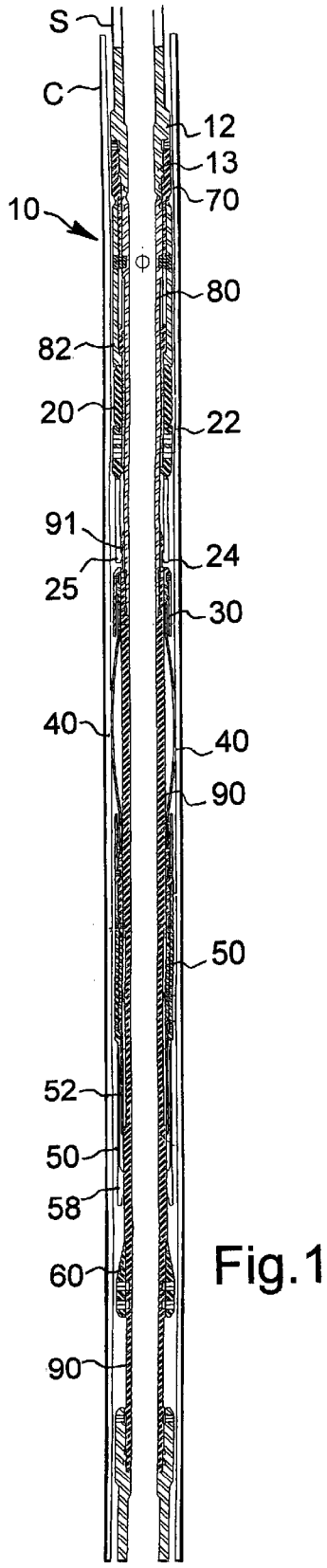
FIG. 1 is a side cross-section view of a system according to the present invention.
Figure 1A:
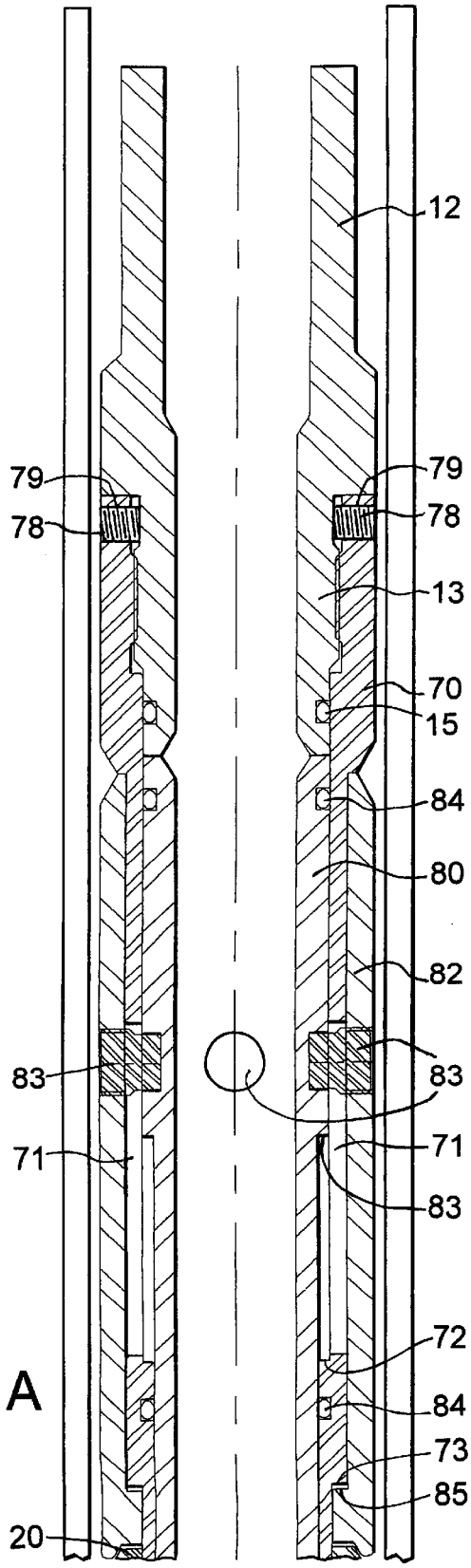
FIGS. 1A–1F are enlargements of portions of the system of FIG. 1.
Figure 1B:
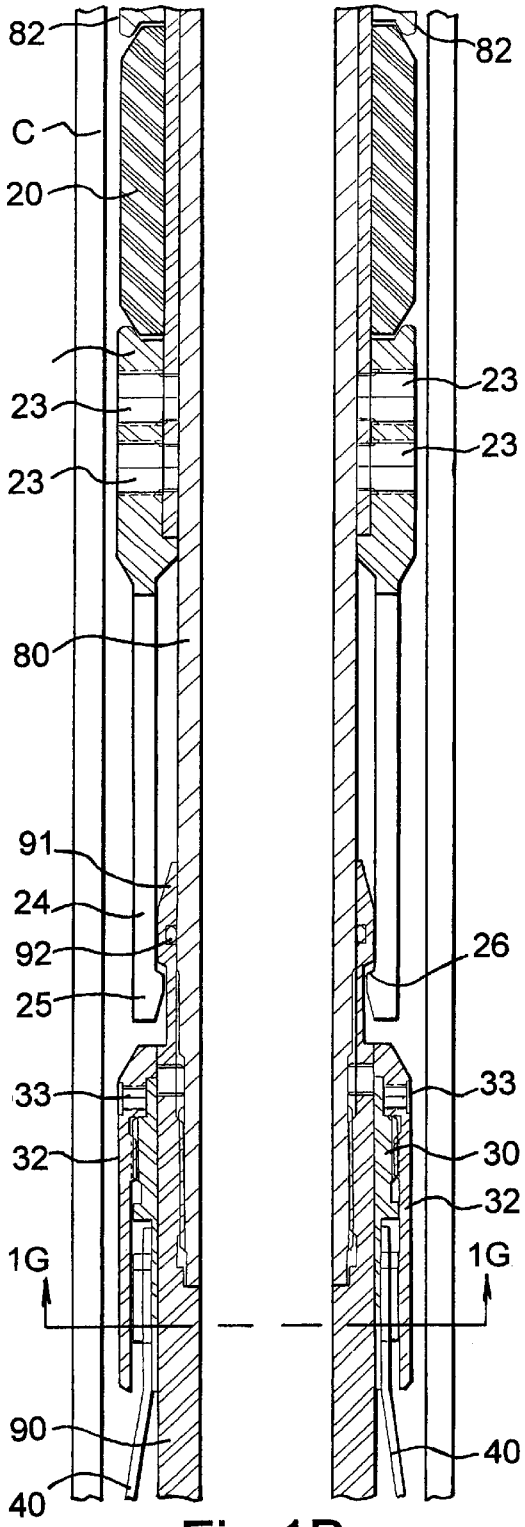
Figure 1C:
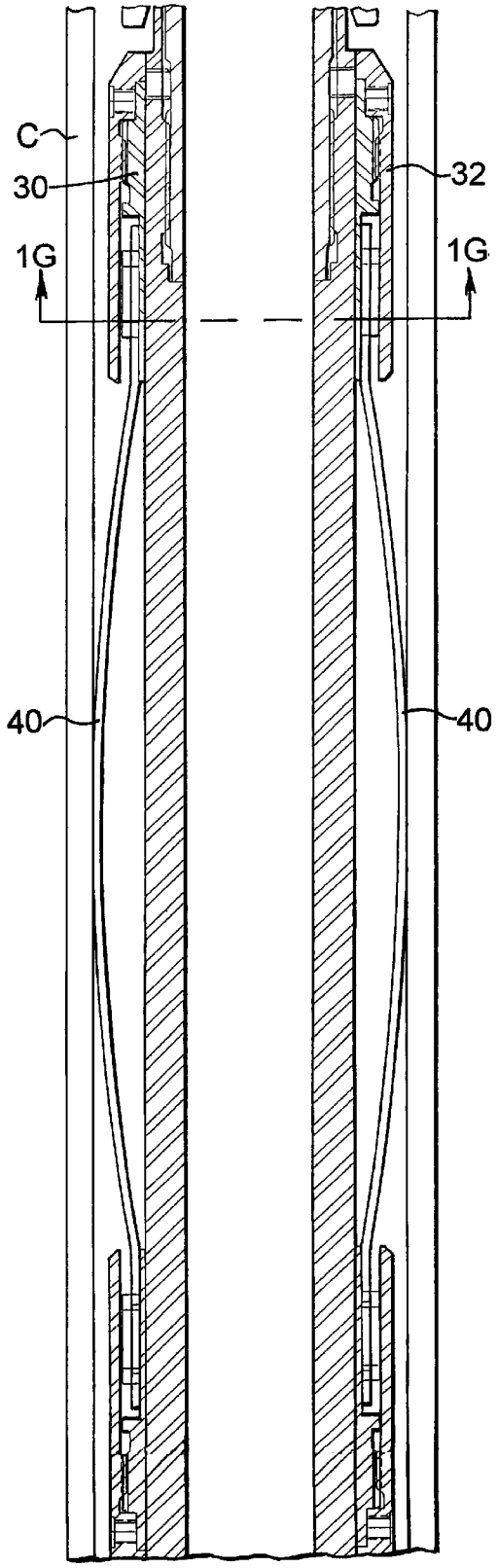

FIG. 1 shows a packer system 10 according to the present invention which has a top sub 12, a packer element 20, a packer element latch 22 drag springs 40, slip elements 50, a cone 60 and a bottom sub 14. FIGS. 1A–1F show enlargements of portions of the packer system 10 shown in FIG. 1. A system according to the present invention may be set within a tubular string (tubing or casing), within a gravel pack screen, within a packer, within a hanger flange, or within any wellbore device, system, tool, or apparatus with a suitable bore therethrough.

The top sub 12 has a lower end 13 to which is threadedly connected a pulling element mandrel 70. Set screws 78 through holes 79 hold the mandrel 70 in place. An o-ring 14 seals the top-sub-mandrel interface.

The mandrel 70 extends down between an upper body 80 and a support 82. Retainer screws 83 secure the upper body 80 and the support 82 together. These screws have a center portion that is movable within slots 71 in the mandrel 70, allowing the mandrel 70 some degree of up-down freedom with respect to the upper body 80 and support 82 (to selectively set or release the packer element 20 as described in detail below ). O-rings 84 seal the mandrel-upper body interface.

The packer element 20 is held between the support 82 and a latch 22. Shear screws 23 extend through the latch 22 and the mandrel 70 to releasably secure the latch 22 to the mandrel 70. The lower end of the upper body 80 is threadedly secured to the upper end of a lower body 90. The mandrel 70 has an internal shoulder 72 and an external shoulder 73. The mandrel 70 is selectively movable upwardly so that the shoulder 72 moves to abut an external shoulder 83 of the upper body 80, and selectively movable downwardly so that the shoulder 73 abuts an internal shoulder 85 of the support 82—thus limiting up and down motion of the mandrel with respect to the upper body 80 and the support 82.

The latch 22 has a lower end 24 that terminates in a collet 25 having an internal shoulder 26. Initially the collet 25 is releasably secured around an upper end 91 of a lower body 90. An o-ring 42 seals the lower body/upper body interface.

Movably disposed around the lower body 90 are the drag springs 40 and their associated mountings and the slip elements 50 which are threadedly connected to a lower retainer sleeve 41 which is connected to a bottom part of drag springs 40.

A lug carrier 51 has an upper end 52 disposed between the slip elements 50 and the lower body 90. The lug carrier is not connected to anything and floats in place. Beneath a lower end of the lug carrier 51 is a debris sleeve 52 connected to a slip body which is described below. Two lug carrier pins 53 spaced apart 180° project inwardly from a recess 54 in the lug carrier 51 and are movable in a recessed track 92 of the lower body 90. Two bearing segments 55 also spaced apart 1800 project inwardly from a recess 56 in the lug carrier 51 and, as is described in detail below, move in grooves 93, 94 in the lower body 90. The bearing segments isolate the pins 53 from loads and forces imposed on a lower body 90.

The debris sleeve 52 prevents debris and unwanted wellbore material from entering into the recesses, tracks, grooves, and spaces between the lug carrier 51 and the lower body 90 in which the pin 53 and the bearing segment 55 move. One or more vent holes 49 through the sleeve 52 prevent hydrostatic locking.

A lower end 58 of each slip element 50 has a toothed gripping portion for releasably securing the slip ends to a casing string C in which the packer system 10 is disposed. One or more vent holes 57 through the slip body prevent hydrostatic locking. It is to be understood that the packer system 10 may be used in any casing string or any other string of tubular members, including, but not limited to, a string of tubing or pipe.

The cone 60 with an upper tapered end 61 is releasably secured to the lower body 90 with shear screws 62 (eight may be used). The upper tapered end 61 is sized and configured for abutment by inner surfaces 59 of the slip ends 58 so that the slip ends 58 are forced outwardly to grip the casing string C.

The bottom sub 14 is releasably secured to the lower body 90 with mating threads and set screws 18 hold the bottom sub in place on the lower body 90. An o-ring 19 seals the bottom sub/lower body interface. The top sub, upper body, mandrel, lower body and the bottom sub are generally cylindrical, each with a top-to-bottom bore.

Figure 1D:
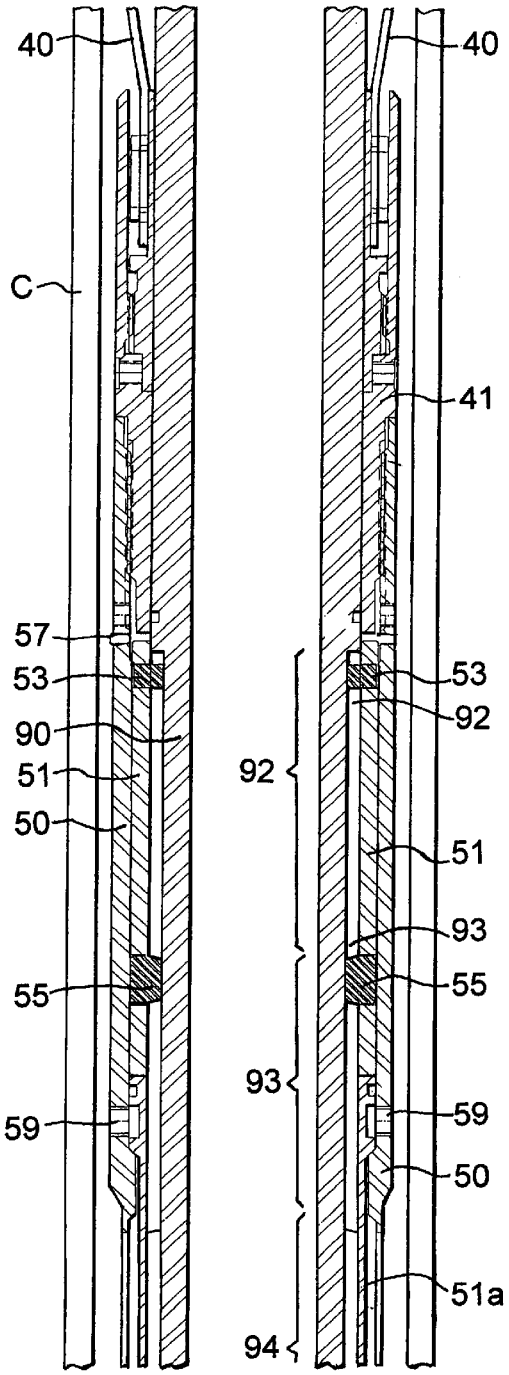
Figure 1E:
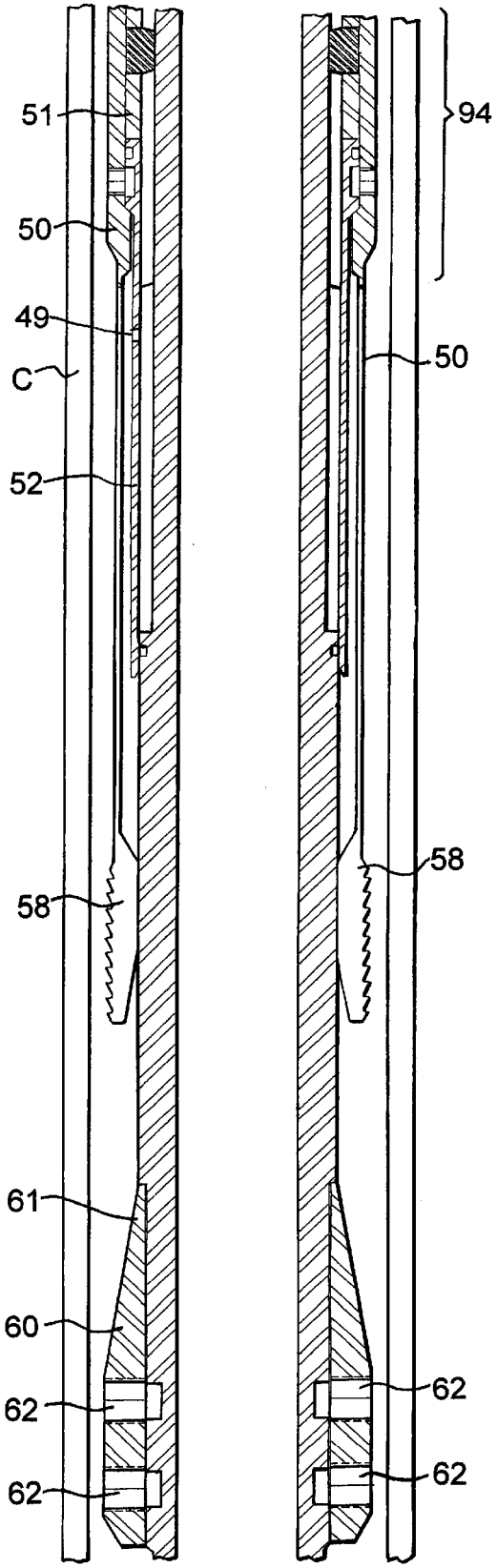
Figure 1F:
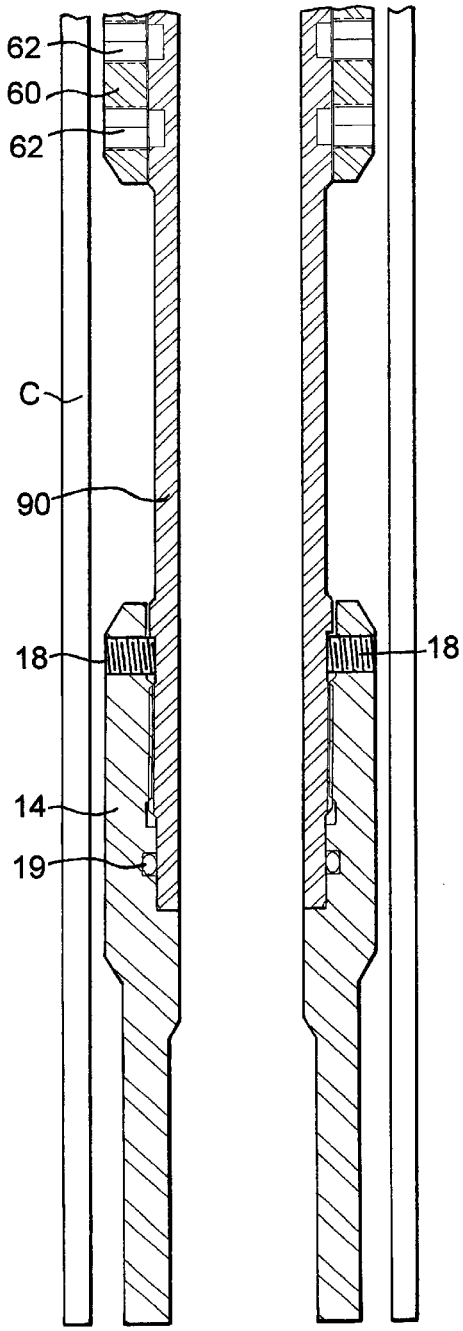
Figure 1G:
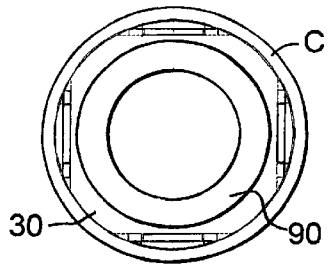
FIG. 1G is a cross-section view along line 1G—1G of FIGS. 1 and 1B.

FIG. 1G is a cross-sectional view taken along line 1G—1G of FIG. 1 (and of FIGS. 1B and 1C) and shows a drag spring carrier 30 and the lower body 90.

Figure 1H:
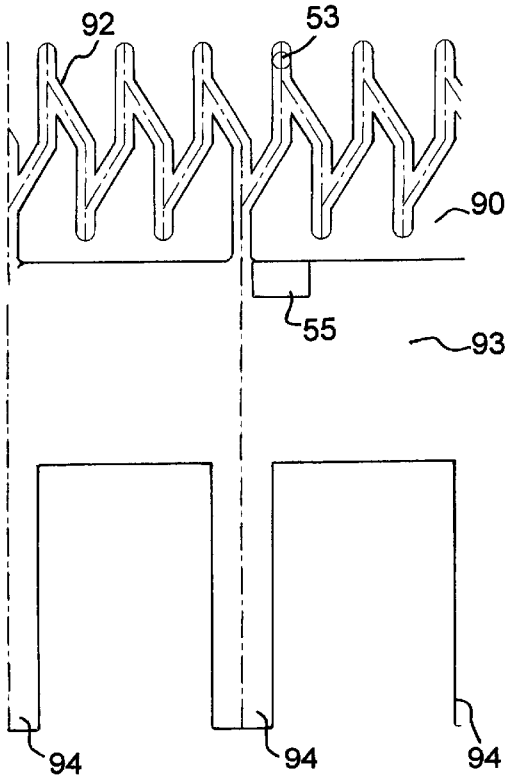
FIG. 1H is a flattened view of a portion of the system of FIG. 1.

FIG. 1H shows a flattened view of the track 92 and the groove 93 of the lower body 90. The carrier pin 53 is shown in one position in FIG. 1H and the bearing segment 55 is shown in a corresponding position. As shown in FIGS. 1D and 1H, the bearing segments 55 are in contact with an upper edge of the groove 93, but the carrier pin 53 is not in contact with an upper edge of the track 92 so that an imposed load or force on the lower body 90 is transmitted to the bearing segments 55 rather than to the carrier pins 53. Thus the carrier pin 53 does not bear such loads or forces. The groove 93 has a lower portion 94 into which the bearing segment is movable for setting the slips as described below in detail.

The packer system 10 as shown in FIG. 1 (and FIGS. 1A–1H) is in a "run in the hole" mode for introducing the system 10 into the casing string C and moving the system 10 down to a desired location. It is within the scope of this invention for the top sub 12 to be connected to any desired connector and/or tubular string, including, but not limited to, to a coiled tubing string, a tubing string, a casing string, or other tubular string—all indicated schematically as string S in FIG. 1.

Figure 2A:
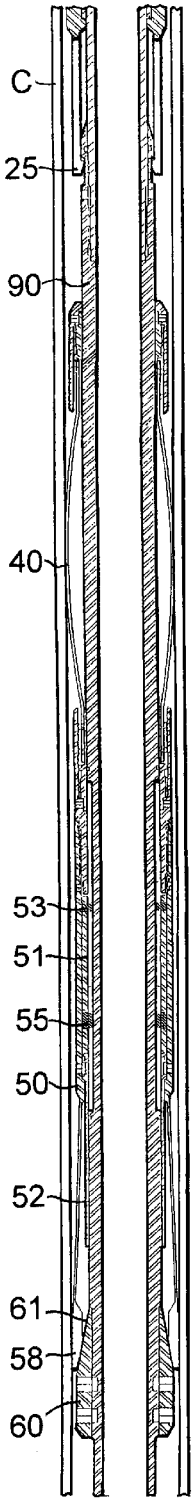
FIGS. 2A–2D are side cross-section views showing various steps in an operation of the system of FIG. 1.

As shown in FIG. 2A, following location of the packer system 10 at a desired location in the casing string C, the top sub 12 and items connected to it (mandrel 70, upper body 80, support 82, lower body 90 and cone 60) have been pulled upwardly by pulling up on the string S to bring the tapered surface 61 of the cone 60 into contact with the slip ends 58, forcing them outwardly to grip the interior of the casing string C, thereby setting the system 10 in place. During this mandrel-pulling step, the drag springs 40 (and the interconnected lug carrier 51, debris sleeve 52 and slip elements 50) remain in place due to the bearing of the drag springs 40 against the interior of the casing string C so that the cone 60 can force the slip ends 58 outwardly. Location of the system at a desired point in the tubular string may be accomplished by any suitable locator system, including, but not limited to, a depth-counter system; MWD; an orienting tool system; a collar locator system; or an electric wireline collar log system.

Figure 2B:
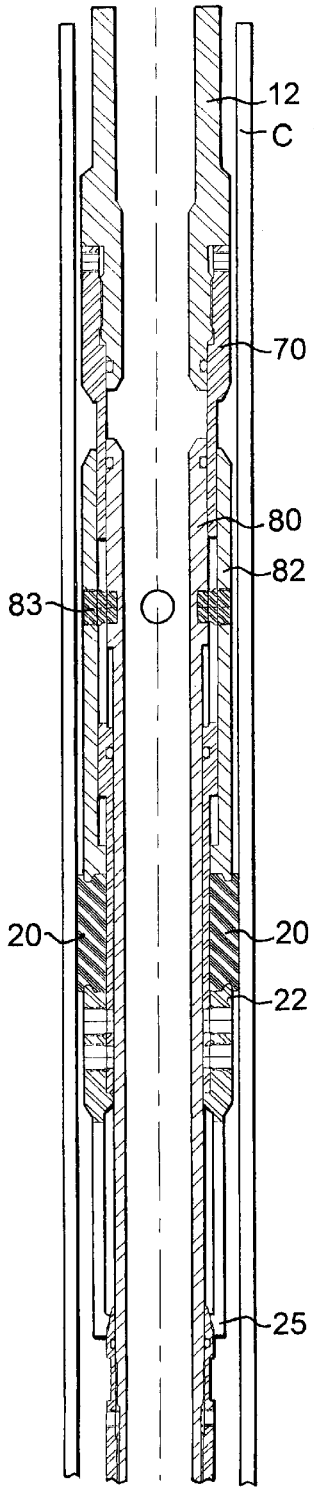

As shown in FIG. 2B, an upward force applied to the top sub 12 and therefore to the mandrel 20 has pulled the collet end 25 up and free of the lower body 90 while, at the same time, forcing the latch 22 up against the packer element 20 forcing it to deform outwardly to seal off the annulus A between the interior of the casing string C and the exterior of the system 10. The shear screws 23 are still releasably securing the latch 22 and the mandrel 70 together in FIG. 2B.

Figure 2C:
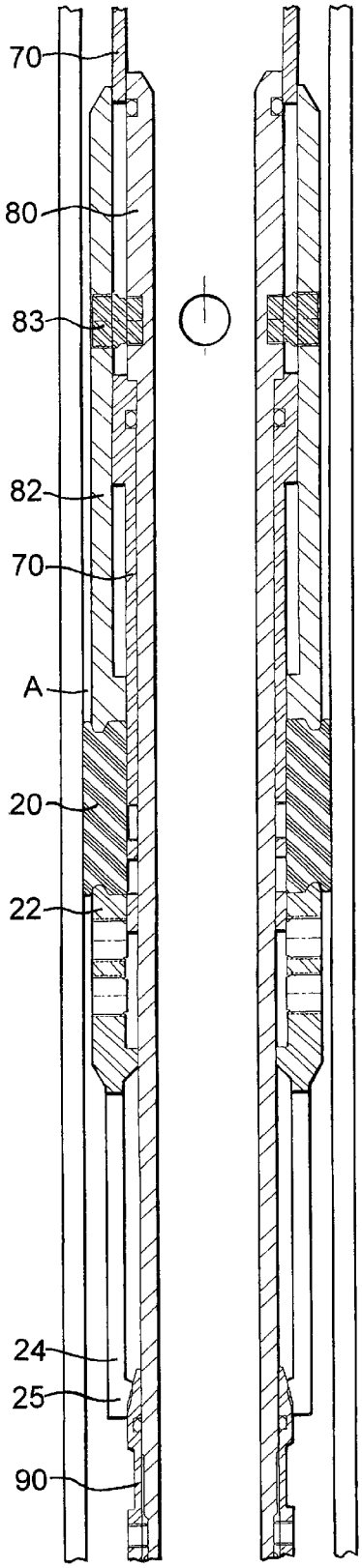

As shown in FIG. 2C, in an emergency situation or a situation in which removal of the system from a wellbore is desired, upward pulling on the top sub 12 and mandrel 70 with sufficient force has sheared the shear screws 23, freeing the mandrel 70 from the latch 22 (with the shoulder 72 of the mandrel 70 now abutting the shoulder 83 of the upper body 80) so that the mandrel 70 and items still connected to it (the upper body 80, lower body 90) can be pulled up further to shear the shear screws holding the cone 60.

Figure 2D:
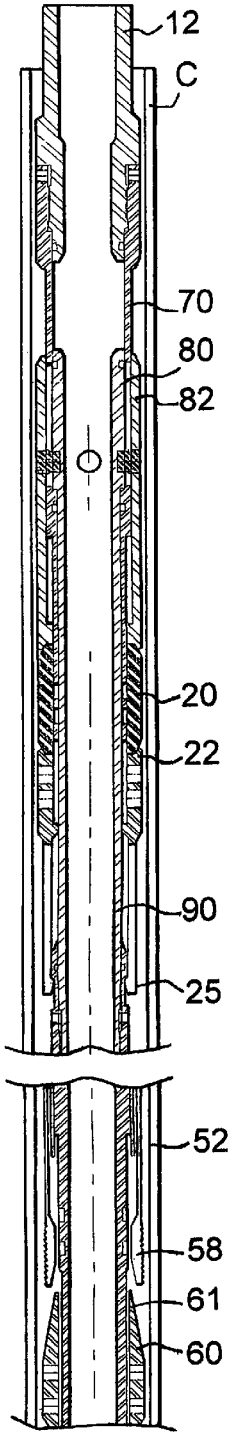

In FIG. 2D the upper shear screws 23 have been sheared by pulling up on the top sub 12, releasing the packer element 20. Further upward pulling on the top sub 12 shears the lower shear screws 62, the cone 60 falls, and the slips are released. If the cone 60 does not fall, the slips are still released since they are pulled up away from the cone and cannot again abut the cone. Then the system is withdrawn from the casing string S.

Figure 3A:
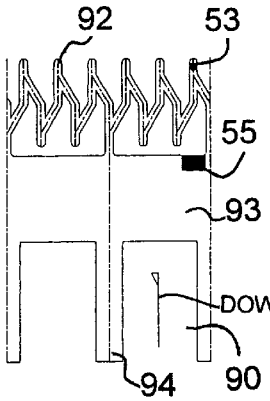
FIGS. 3A–3F illustrate movement of a lower body of the system of FIG. 1 and corresponding carrier pin and bearing segment positions.

FIGS. 3A–3F illustrate the travel of the carrier pin 53 and the bearing segment 55 in the lower body 90's track 92 and groove 93, respectively, and their relative positions during such travel for setting the slips. The positions in FIG. 3A correspond to the run-in step o FIGS. 1 and 1A. The carrier pin 53 is near one of the top portions of the track 92 and the bearing segment is shouldered up against a top edge of the groove 93. This positioning isolates the carrier pin 53 from impacts, forces, and loading imposed on the lower body 90. The system 10 is lowered to the desired location with the carrier pin 53 and the bearing segment 55 as shown in FIG. 3A.

FIGS. 3B–3F include a dual up-down reciprocation of the lower body 90, (although in other embodiments according to the present invention a single up-down track is used and only one such cycle suffices to set the slips 50). By using the dual cycle, a single inadvertent up-down reciprocation of the system does not result in the unwanted setting of the slips.

Figure 3B:
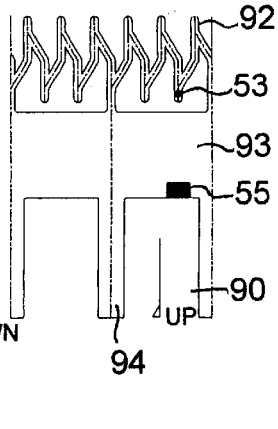

Beginning as shown in FIG. 3B, the lower body 90 is pulled up, moving the carrier pin 53 down in the track 92 and the bearing segment 55 down in the groove 93 until the bearing segment 55 abuts a lower edge of the groove 93 and the carrier pin comes to rest near a lower portion of the track 92. The upward motion of the lower body 90 and the slanted portion of the track 92 rotate the lug carrier 51 (with the carrier pin 53 and the bearing segment 55) with respect to the lower body 90. During this step the drag springs 40 are held fixed due to the frictional holding of the drag springs 40 against the interior of the casing string C. Movement of the lower body 90 stops when the bearing segment shoulders against the lower edge of the groove 93.

Figure 3C:
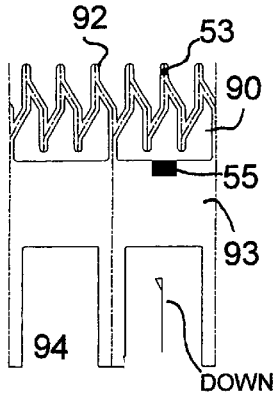
Figure 3D:
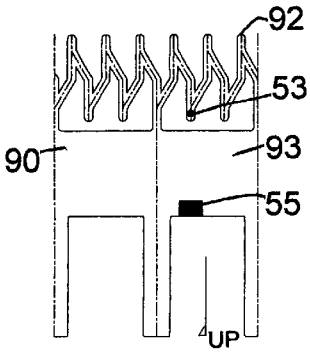
Figure 3E:
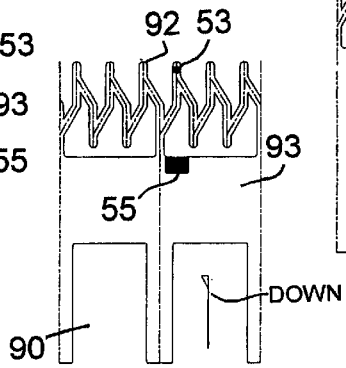

As shown in FIG. 3C, pushing down on the lower body 90 (i.e. pushing down on the string, tubing, casing, coiled tubing etc. interconnected with the top sub 12) moves the lower body 90 to a position which results in which bearing segments 55 are up against the top edge of the groove 93 and, correspondingly, the carrier pins 53 up into an upper portion of the track 92. FIG. 3D shows another upward movement of the lower body 90 (as in FIG. 3B) and the corresponding rotation of the lug carrier 51 and repositioning of the carrier pins 53 and bearing segments 55. Thus the free-floating lug carrier 51 rotates during reciprocation. FIG. 3E illustrates another down movement of the lower body 90, re-positioning the carrier pin 53 and bearing segment 55 as shown.

Figure 3F:
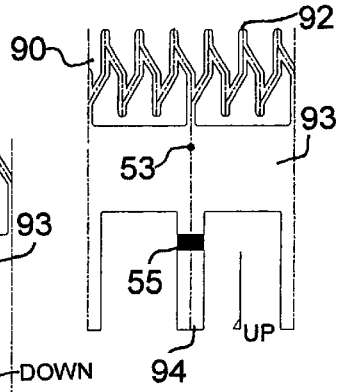

FIG. 3F illustrates another upward motion of the lower body 90 and the re-positioning of the carrier pin 53 and the bearing segment 55 so that the carrier pin 53 is freed from the track 92 and moves into the groove 93, and the bearing segment is positioned above and then moved into the groove 94. This allows the lower body 90 to be raised bringing the tapered surface 61 of the cone 60 up to contact the slip ends 58, moving them out to set against the interior of the casing string C (FIG. 2A). Further upward movement results in the latch 22 releasing from the lower body 90 (see FIG. 2B showing collet end 25 released from lower body) and then pushing up against the packer element 22 to set the packer element 20 (FIG. 2B). Repetition of the cycling illustrated above results in the unsetting of the slips and of the packer, freeing the system for relocation at any other desired location within the tubular string without having to retrieve the system to the surface.

The drag springs 40 and their associated mounting apparatus (and the slips) float freely around the lower body 90. During reciprocation of the lower body 90, three components rotate with respect to the lower body 90—the lug carrier 51, the carrier pins 53, and the bearing segments 55. The lug carrier 51 is free to rotate and is not connected to the lower body 90. Set screws 59 hold the debris sleeve 52 to the slip body.

Figure 4A:
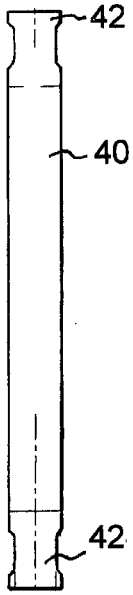
FIG. 4A is a front view of a drag spring according to the present invention.
Figure 4B:
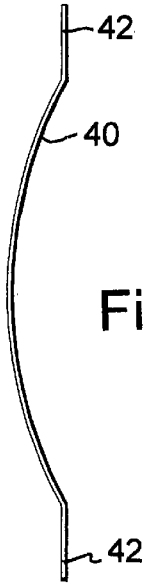
FIG. 4B is a side view of the drag spring of FIG. 4A.

FIGS. 4A and 4B show one of the drag springs 40. FIGS. 5A–5D show a spring carrier 30. Recesses 31 in the outer body of the carrier 30 correspond in shape to the ends 42 of the drag springs 40 shown in FIG. 4A. The drag springs 40 are mounted on the carrier 30 by placing the drag spring ends 42 in the recesses 31 and then threadedly securing a sleeve 32 to the carrier 30. The mounting apparatus for mounting the drag springs in the system of FIG. 1 may also be used, according to the present invention, for mounting bow springs to centralizer bodies or collars, producing a centralizer according to the present invention.

Figure 5A:
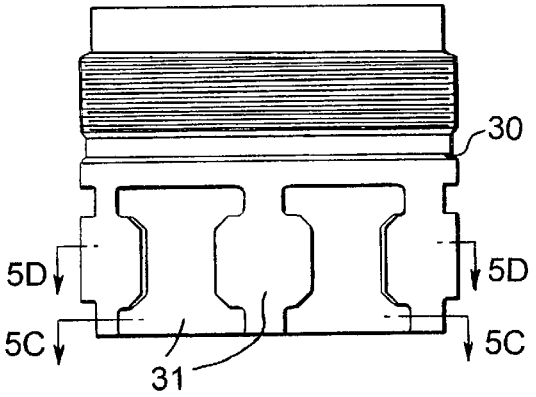
FIG. 5A is a side view of a drag spring carrier according to the present invention.
Figure 5B:
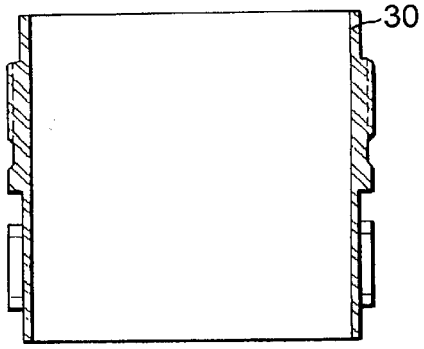
FIG. 5B is a cross-section view of the carrier of FIG. 5A.
Figure 5C:
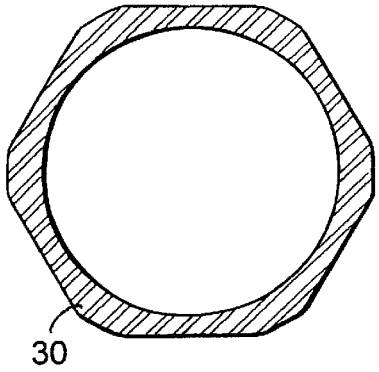
FIG. 5C is a cross-section view along line 5C—5C of FIG. 5A.
Figure 5D:
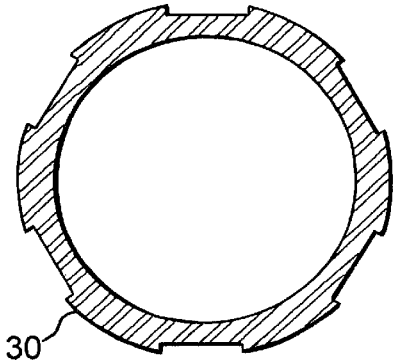
FIG. 5D is a cross-section view along line 5D—5D of FIG. 5A.
Figure 5E:
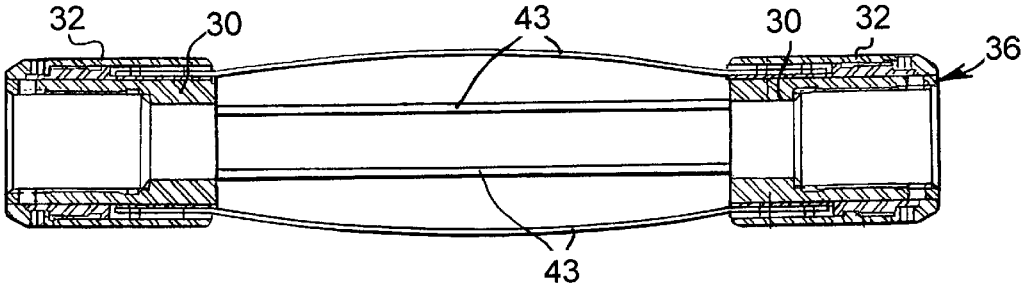
FIG. 5E is a side view of a centralizer according to the present invention.

FIG. 5E shows a centralizer 36 according to the present invention which has a plurality of spring bows 43 spaced-apart around the centralizer. The centralizer 36 has two spaced-apart carriers 30 (like the carrier 30 of FIG. 5A) each with a sleeve 32 (like the sleeve 32 in FIG. 1C). Any suitable number of spring bows may be used. The spring bows 43 have ends like the ends 42 of the drag springs 40 and the ends 43 are mounted on the carriers as are the ends 43 described above.

Figure 6:
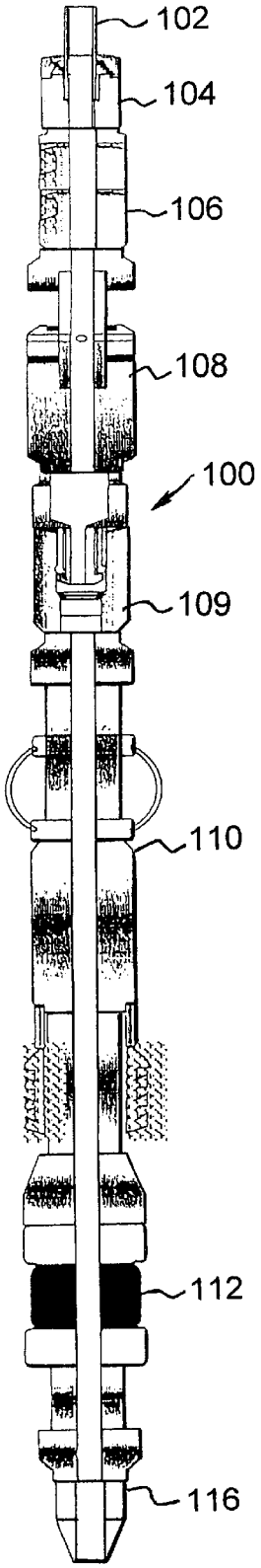
FIG. 6 is a side schematic view of a system according to the present invention.

FIG. 6 illustrates a system 100 for use in various well operations, e.g. but not limited to, well completion operations and formation fracturing ("frac jobs"), acidizing, tubing testing, pressure testing, water shut off, gel treatments, squeezing operations and various other remedial service jobs.

A string 102 [e.g. but not limited to a tubular string (e.g. tubing or casing) or a coiled tubing string] is connected via a connector 104 to an optional check valve 106 which is connected to an optional unloader 108. Disconnect 109 is connected between the unloader and a packer system 110 which may be any suitable packer, including but not limited to, the system 10 described above or an invertible packer as provided by Petro-Tech Tools, Inc., e.g. the Model A or B Invertible Packer. Any suitable tension set or hydraulic set packer may also be used. A bull nose 116 is mounted beneath at the bottom of the system 100.

If coiled tubing is used, and the check valve 106 and the unloader 108 are deleted, the coiled tubing connector is connected to a top part of the disconnect 109. Suitable central top-to-bottom bores are provided in the components of the system 110.

The check valve 106 is used to prevent wellbore fluid in space around the system from going back up into the string 102 and, in certain aspects, to prevent fluid under pressure from causing a blowout at or near the surface. Any suitable sub or apparatus with one or more check valves or flappers may be used, including, but not limited to known double flapper check valves. The unloader 108 is used to equalize pressures between a coiled tubing string 102 and the space or annulus around and/or below the system. In one aspect a Set-Down Unloader as provided by Petro-Tech Tools, Inc., e.g. Product No. 3535, is used. Any suitable unloader may be used. The Set-Down Unloader equalizes pressure across the packer of the system 110 prior to releasing the packer. With differential pressure from below the packer, it may not be possible to set down enough weight to release the packer. With the differential pressure above a tension-set packer, equalizing across the packer during release may damage the packer element and prevent further settings of the packer. In cases in which the pressures cannot be equalized at the surface, a Set-Down Unloader can be used.

Using a system according to the present invention, including but not limited to a system as in FIG. 1 or FIG. 6, a packer can be run into a hole into a tubular string and set in tension and the system can be removed from the wellbore in an emergency situation. In a typical "frac job" according to the present invention with a system as in FIG. 6, the system is connected to a coil tubing string and run into a wellbore, in one aspect a cased wellbore, to a desired location. The system is set in place and the packer element of the system is set. Then formation fracturing fluid is pumped down the coil tubing to the formation. Upon completion of the fluid flow, the packer element is released and the slips are released; and the system is retrieved from the wellbore or relocated therein. In certain aspects, the packer is allowed to equalize and the packer element is allowed to return to its un-set state. The disconnect 109 may be any suitable disconnect, including, but not limited to, a disconnect as disclosed herein according to the present invention, or a prior art disconnect, including, but not limited to, an hydraulically actuated disconnect, a mechanical disconnect, or an overpull disconnect.

Figure 7A:
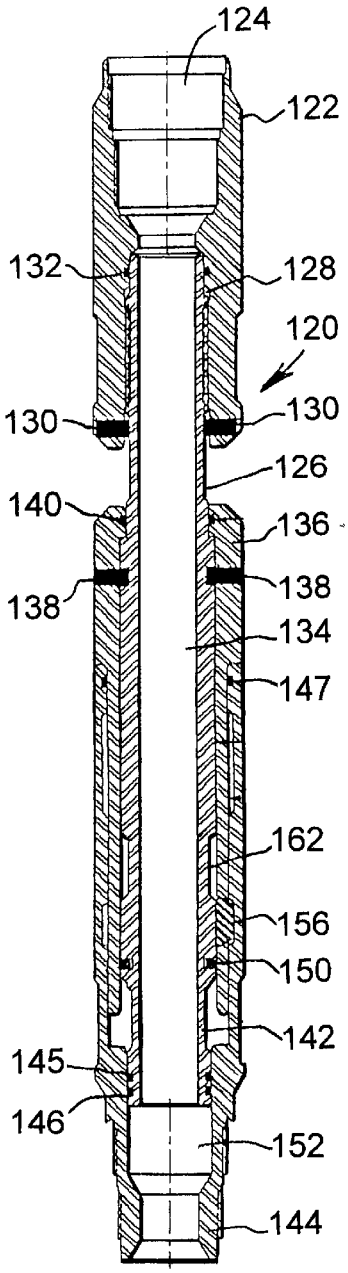
FIGS. 7A and 7B are side cross-section views of a disconnect according to the present invention.
Figure 7B:
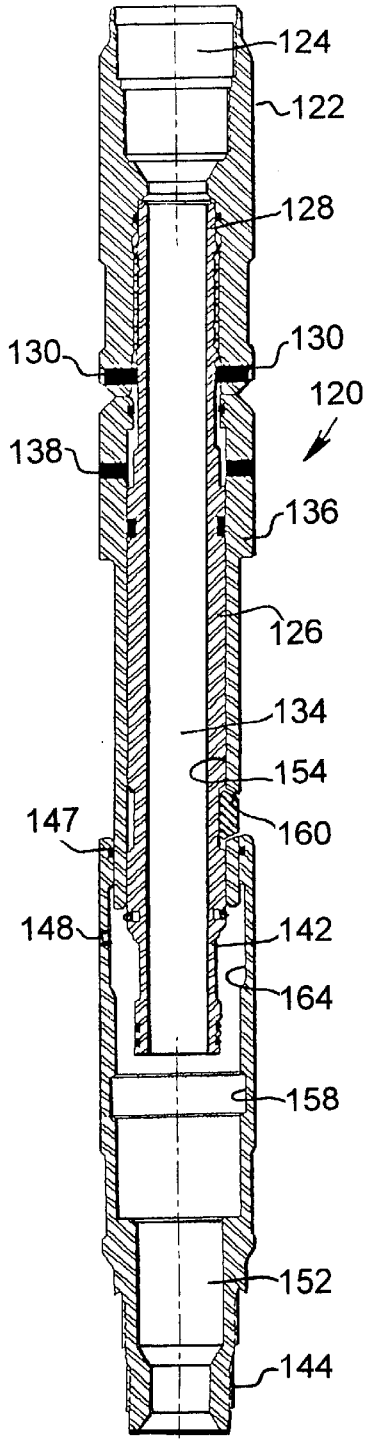

FIGS. 7A and 7B show a set-down disconnect 120 according to the present invention which may be used as the disconnect 109 (FIG. 6). A top sub 122 has a central bore 124 therethrough from top to bottom and an upper end 128 of a mandrel 126 is threadedly secured in the top sub 122 and set screws 130 hold it in place. An o-ring 132 seals the top sub/mandrel interface. The mandrel 126 has a central flow bore 134 therethrough from top to bottom and a lower part releasably secured to a lug carrier 136 with shear pins 138. O-rings 140, 141 seals the mandrel/lug carrier interface. A lower end 142 of the mandrel 126 extends into a bottom sub 144 and o-rings 145, 146 seal the bottom sub/mandrel interface. An o-ring 147 seals the bottom sub/lug carrier interface. A vent hole (or holes) 148 through the wall of the bottom sub 144 prevents hydrostatic locking. A control ring 150 prevents the mandrel from falling (from the position of FIG. 7B) and, therefore, prevents the lugs from returning to the position of FIG. 7A. A central flow bore 152 extends through the bottom sub 144 from top to bottom. A central bore 154 extends through the lug carrier from top to bottom.

Initially part of each of three lugs 156 is in a corresponding recess 158 in the bottom sub 144. One, two, three, four or more lugs may be used. There are three such recesses and three such lugs spaced-apart around the circumference of the generally cylindrical bottom sub generally cylindrical lug carrier, and generally cylindrical mandrel. Initially another part of each of the three lugs 156 is disposed in a window 160 in the lug carrier 136. Grooves 162 in the mandrel 126 are configured for receiving a portion of each lug 156. A fishing neck 164 is provided on the top inner surface of the bottom sub 144.

Any suitable tubular string, device(s), and/or wellbore apparatuses may be connected to the bottom sub 144.

As shown in FIG. 7A, following sufficient downward force on the top sub 122, the shear pins 138 are sheared freeing the top sub 122 and the mandrel 126 attached thereto for upward movement with respect to the bottom sub 144. Downward movement of the top sub-mandrel combination moves the grooves 162 into axial registry with the lugs 156 and, due to the slanted top surface of the lugs and corresponding slanted surfaces on the lug carrier, the lugs 156 are forced to move inwardly into the grooves 162, thereby connecting the lug carrier 136 to the mandrel 126. An upward pull on the top sub then results in removal of the top sub-mandrel-lug carrier combination from the bottom sub 144 (and from whatever is connected to the bottom sub, e.g., but not limited to, a packer, packer system, and/or other apparatus as in FIG. 6). Instead of the lugs shown in FIG. 7A, a collet end or multiple collet fingers may be used on the lug carrier to selectively and releasably grip the mandrel.

A disconnect 120 according to the present invention may be used, among other uses, when a formation fracturing fluid has filled the wellbore apparatus and/or coiled tubing used during a "frac job," thus making it difficult or impossible to effectively use a ball-activated disconnect. Also such a disconnect can be used when a tension-set packer has been used and a tension-separated disconnect will not work.

The present invention therefore, in certain but not necessarily all embodiments, provides a wellbore system with a tubular string extending from an earth surface down into a wellbore in the earth, a packer system with a selectively settable packer element, and a disconnect located between an end of the tubular string and the packer system, the disconnect operable from the surface by imposing a downward force on the tubular string. Such a wellbore system may have one or some of the following in any possible combination: wherein the packer system's packer element is a tension-set packer element; wherein the packer system's packer element is an hydraulically-set packer element; wherein the disconnect has a top sub, a mandrel having an upper end secured to the top sub and a portion below the upper end releasably secured with at least one releasable member to a carrier member, the carrier member having apparatus for selectively gripping the mandrel, the apparatus for selectively gripping the mandrel also selectively gripping a bottom sub within which the mandrel is movable, the at least one releasable member releasable in response to a downward force on the disconnect; wherein each of the tubular string, packer system, and disconnect have a flow bore therethrough from top to bottom so that fluid is flowable through the wellbore system; wherein the fluid is formation fracturing fluid; wherein the fluid is acidizing fluid; selectively settable gripping apparatus for gripping an interior of a bore in which the wellbore system is located; selective cycling apparatus for selective setting of the selectively settable gripping apparatus at a desired location in the wellbore; friction drag apparatus for fixing part of the selective cycling apparatus at a desired location in the wellbore; wherein the friction drag apparatus includes a carrier with a generally cylindrical hollow body having a bore therethrough from a top to a bottom thereof, the carrier disposed around a lower body of the wellbore system, a plurality of spaced apart recesses in an exterior of the generally cylindrical hollow body, a plurality of spaced apart drag springs each with an end within and corresponding in shape to a shape of the plurality of spaced-apart recesses, and an outer sleeve secured to the generally cylindrical hollow body and releasably holding the drag spring ends within the plurality of spaced-apart recesses; two of the carriers spaced-apart from each other with each drag spring having an end mounted to each carrier, each carrier disposed around the lower body of the wellbore system; wherein the selective cycling apparatus permits setting of the wellbore system, subsequent un-setting of the wellbore system, re-location of the wellbore system within the wellbore, and re-setting of the wellbore system within the wellbore without retrieval of the wellbore system to the earth surface; wherein the cycling apparatus includes a generally cylindrical hollow body within the system having a cycling track formed therein, and a lug carrier positioned adjacent the generally cylindrical hollow body with at least one carrier pin projecting into the cycling track of the generally cylindrical hollow body, the cycling track configured so that reciprocation of the generally cylindrical hollow body by reciprocating the tubular string up and down selectively sets the selectively settable gripping apparatus; at least one bearing segment projecting inwardly from the lug carrier and movable with respect to a groove beneath the cycling track, the groove having an upper edge and a lower edge, the at least one bearing segment configured and positioned to abut either the upper or lower edge of the groove to isolate the at least one carrier pin from loads applied to the generally cylindrical hollow body; wherein at least two up-down reciprocations of the tubular string are required to set the selectively settable gripping apparatus; wherein the tubular string is coil tubing interconnected with the disconnect; an unloader in the system; a check valve apparatus in the system; a debris sleeve connected to the selectively settable gripping apparatus for inhibiting the passage of debris to the cycling track and to the groove; wherein the selectively settable gripping apparatus includes slip apparatus selectively actuable to grip the interior of the bore in which the wellbore system is located, and cone apparatus on a body within the packer system, the cone apparatus haveing a tapered surface so that raising of the body brings the tapered surface into contact with the slip apparatus urging the slip apparatus into engagement with the interior of the bore in which the wellbore system is located; and/or shear apparatus releasably holding the cone apparatus to the body within the packer system so that shearing of the shear apparatus by applying a force thereto frees the slips from engagement with the bore in which the wellbore system is located, thereby releasing the packer system for removal from the wellbore.

The present invention therefore, in certain but not necessarily all embodiments, provides a wellbore system with a tubular string extending from an earth surface down into a wellbore in the earth, a packer system with a selectively settable packer element, a disconnect located between an end of the tubular string and the packer system, the disconnect operable from the surface by imposing a downward force on the tubular string, selectively settable gripping apparatus for gripping an interior of a bore in which the wellbore system is located, an unloader in the system, and a check valve apparatus in the system.

The present invention therefore, in certain but not necessarily all embodiments, provides a wellbore disconnect with a top sub, a mandrel having an upper end secured to the top sub and a portion below the upper end releasably secured with at least one releasable member to a carrier member, the carrier member having apparatus for selectively gripping the mandrel, the apparatus for selectively gripping the mandrel also selectively gripping a bottom sub within which the mandrel is movable, the at least one releasable member releasable in response to a downward force on the disconnect.

The present invention therefore, in certain but not necessarily all embodiments, provides a method for setting a packer element of a wellbore system at a desired location in a wellbore, the wellbore system comprising a tubular string extending from an earth surface down into a wellbore in the earth, a packer system with a selectively settable packer element, and a disconnect located between an end of the tubular string and the packer system, the disconnect operable from the surface by imposing a downward force on the tubular string, the method including introducing the wellbore system into the wellbore, locating the wellbore system at a desired location in the wellbore, and setting the selectively settable packer element. Such a method may also include: wherein the packer system's packer element is a tension-set packer element, the method further inlcuding setting the selectively settable packer element by imposing tension on the tubular string; operating the disconnect to separate the wellbore system from at least one item connected beneath it; wherein the wellbore system includes selectively settable gripping apparatus for gripping an interior of a bore in which the wellbore system is located, the method further including setting the selectively settable gripping apparatus within the wellbore; releasing the selectively settable gripping apparatus to permit removal of the packer system from the wellbore; wherein the selectively settable gripping apparatus includes shear apparatus connected to a body within the packer system so that shearing the shear apparatus by pulling on the packer system and thereby pulling on the body therewithin shears the shear apparatus, freeing the selectively settable gripping apparatus to permit removal of the packer system from the wellbore; and/or wherein the packer element is set in a bore in an item from the group consisting of a tubular in a tubular string of tubing or of casing, a gravel pack screen, a packer, a hanger flange, and a wellbore tool with a top-to-bottom bore therethrough.

The present invention therefore, in certain but not necessarily all embodiments, provides a method for disconnecting a first item in a wellbore from a second item in a wellbore, the method inlcuding positioning a disconnect between the first item and the second item, the disconnect operable from an earth surface by imposing a downward force on it, the disconnect having a top sub, a mandrel having an upper end secured to the top sub and a portion below the upper end releasably secured with at least one releasable member to a carrier member, the carrier member having apparatus for selectively gripping the mandrel, the apparatus for selectively gripping the mandrel also selectively gripping a bottom sub within which the mandrel is movable, the at least one releasable member releasable in response to a downward force on the disconnect, introducing the first item, the disconnect, and second item into the wellbore, and imposing a downward force on the disconnect to separate it and the first item from the second item.

The present invention therefore, in certain but not necessarily all embodiments, provides a wellbore spring apparatus inclduing two spaced-apart carriers each with a generally cylindrical hollow body having a bore therethrough from a top to a bottom thereof, a plurality of spaced apart recesses in an exterior of each carrier's generally cylindrical hollow body, a plurality of springs spaced-apart around the carriers, each spring with ends within and corresponding in shape to a shape of the plurality of spaced-apart recesses, and two outer sleeves, each secured to a carrier's generally cylindrical hollow body and releasably holding spring ends within the plurality of spaced-apart recesses.

The present invention therefore, in certain but not necessarily all embodiments, provides a method for performing a wellbore formation fracturing operation, the wellbore extending through a formation in the earth, the method including interconnecting a packer system to an end of a tubular string, the packer system including a tension-set packer, a disconnect inerconnected to the tubular string and located between the packer system and the tubular string, the tubular string, packer system, and disconnect each having a fluid flow bore theretherough, moving the tubular string to move the disconnect and the packer system into a wellbore to a desired lcoation therein, setting the packer system in place at the desired location in the wellbore, setting the tension-set packer, and pumping formation fracturing fluid through the tubular string, through the disconnect, through the pakce system, and to the formation. Such a method may include: wherein the tubular string is coil tubing; and/or wherein the disconnect is a set-down disconnect.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. A wellbore system comprising a tubular string extending from an earth surface down into a wellbore in the earth, a packer system with a selectively settable packer element, and a disconnect located between an end of the tubular string and the packer system, the disconnect operable from the surface by imposing a downward force on the tubular string.

2. The wellbore system of claim 1 wherein the packer system's packer element is a tension-set packer element.

3. The wellbore system of claim 1 wherein the packer system's packer element is an hydraulically-set packer element.

4. The wellbore system of claim 1 wherein the disconnect has a top sub, a mandrel having an upper end secured to the top sub and a portion below the upper end releasably secured with at least one releasable member to a carrier member, the carrier member having apparatus for selectively gripping the mandrel, the apparatus for selectively gripping the mandrel also selectively gripping a bottom sub within which the mandrel is movable, the at least one releasable member releasable in response to a downward force on the disconnect.

5. The wellbore system of claim 1 wherein each of the tubular string, packer system, and disconnect have a flow bore therethrough from top to bottom so that fluid is flowable through the wellbore system.

6. The wellbore system of claim 5 wherein the fluid is formation fracturing fluid.

7. The wellbore system of claim 5 wherein the fluid is acidizing fluid.

8. The wellbore system of claim 1 further comprising selectively settable gripping apparatus for gripping an interior of a bore in which the wellbore system is located.

9. The wellbore system of claim 8 further comprising selective cycling apparatus for selective setting of the selectively settable gripping apparatus at a desired location in the wellbore.

10. The wellbore system of claim 9 further comprising friction drag apparatus for fixing part of the selective cycling apparatus at a desired location in the wellbore.

11. The wellbore system of claim 10 wherein the friction drag apparatus further comprises a carrier with a generally cylindrical hollow body having a bore therethrough from a top to a bottom thereof, the carrier disposed around a lower body of the wellbore system, a plurality of spaced apart recesses in an exterior of the generally cylindrical hollow body, a plurality of spaced apart drag springs each with a first end within and corresponding in shape to a shape of the plurality of spaced-apart recesses, and an outer sleeve secured to the generally cylindrical hollow body and releasably holding the first ends of the drag springs within the plurality of spaced-apart recesses.

12. The wellbore system of claim 11 further comprising two carriers as in claim 11, the two carriers spaced-apart from each other with each drag spring having an end mounted to each carrier, each carrier disposed around the lower body of the wellbore system.

13. The wellbore system of claim 9 wherein the selective cycling apparatus permits setting of the wellbore system, subsequent un-setting of the wellbore system, re-location of the wellbore system within the wellbore, and re-setting of the wellbore system within the wellbore without retrieval of the wellbore system to the earth surface.

14. The wellbore system of claim 9 wherein the cycling apparatus includes a generally cylindrical hollow body within the system having a cycling track formed therein, and a lug carrier positioned adjacent the generally cylindrical hollow body with at least one carrier pin projecting into the cycling track of the generally cylindrical hollow body, the cycling track configured so that reciprocation of the generally cylindrical hollow body by reciprocating the tubular string up and down selectively sets the selectively settable gripping apparatus.

15. The wellbore system of claim 14 further comprising at least one bearing segment projecting inwardly from the lug carrier and movable with respect to a groove beneath the cycling track, the groove having an upper edge and a lower edge, the at least one bearing segment configured and positioned to abut either the upper or lower edge of the groove to isolate the at least one carrier pin from loads applied to the generally cylindrical hollow body.

16. The wellbore system of claim further comprising a debris sleeve conneted to the selectively settable gripping apparatus for inhibiting the passage of debris to the cycling track and to the groove.

17. The wellbore system of claim 14 wherein at least two up-down reciprocations of the tubular string are required to set the selectively settable gripping apparatus.

18. The wellbore system of claim 8 wherein the selectively settable gripping apparatus further comprises slip apparatus selectively actuable to grip the interior of the bore in which the wellbore system is located, and cone apparatus on a body within the packer system, the cone apparatus having a tapered surface so that raising of the body brings the tapered surface into contact with the slip apparatus urging the slip apparatus into engagement with the interior of the bore in which the wellbore system is located.

19. The wellbore system of claim 18 further comprising shear apparatus releasably holding the cone apparatus to the body within the packer system so that shearing of the shear apparatus by applying a force thereto frees the slips from engagement with the bore in which the wellbore system is located, thereby releasing the packer system for removal from the wellbore.

20. The wellbore system of claim 1 wherein the tubular string is coil tubing interconnected with the disconnect.

21. The wellbore system of claim 1 further comprising an unloader in the system.

22. The wellbore system of claim 1 further comprising a check valve apparatus in the system.

23. A wellbore system comprising a tubular string extending from an earth surface down into a wellbore in the earth, a packer system with a selectively settable packer element, a disconnect located between an end of the tubular string and the packer system, the disconnect operable from the surface by imposing a downward force on the tubular string, selectively settable gripping apparatus for gripping an interior of a bore in which the wellbore system is located, an unloader in the system, and a check valve apparatus in the system.

24. A method for setting a packer element of a wellbore system at a desired location in a wellbore, the wellbore system comprising a tubular string extending from an earth surface down into a wellbore in the earth, a packer system with a selectively settable packer element, and a disconnect located between an end of the tubular string and the packer system, the disconnect operable from the surface by imposing a downward force on the tubular string, the method comprising introducing the wellbore system into the wellbore, locating the wellbore system at a desired location in the wellbore, and setting the selectively settable packer element.

25. The method of claim 24 wherein the packer system's packer element is a tension-set packer element, the method further comprising setting the selectively settable packer element by imposing tension on the tubular string.

26. The method of claim 24 further comprising operating the disconnect to separate the wellbore system from at least one item connected beneath it.

27. The method of claim 24 wherein the wellbore system includes selectively settable gripping apparatus for gripping an interior of a bore in which the wellbore system is located, the method further comprising setting the selectively settable gripping apparatus within the wellbore.

28. The method of claim 24 wherein the wellbore system includes selectively settable gripping apparatus for gripping an interior of a bore in which the wellbore system is located, the method further comprising releasing the selectively settable gripping apparatus to permit removal of the packer system from the wellbore.

29. The method of claim 28 wherein the selectively settable gripping apparatus includes shear apparatus connected to a body within the packer system so that shearing the shear apparatus by pulling on the packer system and thereby pulling on the body therewithin shears the shear apparatus, freeing the selectively settable gripping apparatus to permit removal of the packer system from the wellbore.

30. The method of claim 24 wherein the packer element is set in a bore in an item from the group consisting of a tubular in a tubular string of tubing or of casing, a gravel pack screen, a packer, a hanger flange, and a wellbore tool with a top-to-bottom bore therethrough.

* * * * *

UNITED STATES PATENT AND TRADEMARK OFFICE

CERTIFICATE OF CORRECTION

PATENT NO. : 6,257,339 B1 
DATED : July 10, 2001
INVENTOR(S) : David Michael Haugen, Gary Duron Ingram, Corey Eugene Hoffman and Robert Stephen Beeman It is certified that error appears in the above-identified patent and that said Letters Patent is hereby corrected as shown below:

Column 1,
Line 19, please delete “no” before “coil”.

Column 4,
Line 20, please replace “1800” with -- 180 degrees --.

Column 13,
Line 34, please add “15” after “claim”.

Signed and Sealed this

Eighteenth Day of June, 2002

*Attest:*

*Attesting Officer*

JAMES E. ROGAN
*Director of the United States Patent and Trademark Office*